US010173234B2

(12) United States Patent
Hoffmann et al.

(10) Patent No.: US 10,173,234 B2
(45) Date of Patent: Jan. 8, 2019

(54) TRIGGER PUMP DISPENSER WITH INTERCHANGEABLE PISTON

(71) Applicant: Obrist Closures Switzerland GmbH, Reinach (CH)

(72) Inventors: Christoph Hoffmann, Zell/Mosel (DE); Juergen Pellenz, Bremm (DE); Klaus Thanisch, Bullay (DE); Peter Stoelben, Briedel Mosel (DE); Klaus Natersky, Grenderich (DE)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 14/818,116

(22) Filed: Aug. 4, 2015

(65) Prior Publication Data

US 2015/0336123 A1 Nov. 26, 2015

Related U.S. Application Data

(62) Division of application No. 13/824,949, filed as application No. PCT/GB2012/000426 on May 14, 2012, now Pat. No. 9,132,441.

(30) Foreign Application Priority Data

Jun. 16, 2011 (GB) ..... 1110250.6

(51) Int. Cl.
*B05B 11/00* (2006.01)
*B05B 1/12* (2006.01)

(52) U.S. Cl.
CPC ..... *B05B 11/3014* (2013.01); *B05B 1/12* (2013.01); *B05B 11/007* (2013.01); (Continued)

(58) Field of Classification Search
CPC ..... B05B 11/3059; B05B 11/0032; B05B 11/007; B05B 11/3011; B05B 1/12; (Continued)

(56) References Cited

U.S. PATENT DOCUMENTS 4,191,313 A 3/1980 Blake et al.
4,204,614 A 5/1980 Reeve
(Continued)

FOREIGN PATENT DOCUMENTS

EP 0061233 A1 9/1982
EP 0128585 A2 12/1984
(Continued)

OTHER PUBLICATIONS

Positive Displacement Reciprocating Pump Fundamentals—Power and Direct Acting Types; Tackett, Jr., et al.; Proceedings of the Twenty-Fourth International Pump Users Symposium, 2008; retrieved from the internet on Oct. 5, 2017; <http://turbolab.tamu.edu/proc/pumpproc/P24/06-tackett.pdf>.*
(Continued)

*Primary Examiner* — Patrick M. Buechner
(74) *Attorney, Agent, or Firm* — McCoy Russell LLP

(57) ABSTRACT

A trigger pump dispenser comprises a body, an outlet nozzle, a pump chamber, a piston for defining a variable volume in the pump chamber, a trigger coupled with the piston by interconnection means, and biasing means for biasing the trigger to a retracted position. The trigger is movable to cause the piston to pump liquid into and out of the pump chamber for dispensing through the outlet nozzle. The piston is interchangeably associatable with the trigger and the pump chamber so that different length pistons are usable to determine different maximum fill volumes of the pump chamber.

19 Claims, 7 Drawing Sheets

(52) U.S. Cl.
CPC ..... *B05B 11/0027* (2013.01); *B05B 11/0032* (2013.01); *B05B 11/3005* (2013.01); *B05B 11/3011* (2013.01); *B05B 11/3059* (2013.01)

(58) Field of Classification Search
CPC . B05B 1/1645; B05B 1/1654; B05B 11/0027; B05B 11/3053; B05B 11/3009; B05B 11/3052; B05B 11/3056; B05B 11/3057; B05B 11/306; B05B 11/3014; B05B 11/3005
USPC ... 222/25, 28, 41, 47, 48, 321.8, 383.1, 288, 222/385
See application file for complete search history.

(56) References Cited

U.S. PATENT DOCUMENTS 4,890,792 A 1/1990 Martin et al.
4,971,227 A 11/1990 Knickerbocker et al.
5,040,702 A 8/1991 Knickerbocker et al.
5,169,032 A 12/1992 Steijns et al.
5,228,600 A 6/1993 Steijns et al.
5,228,602 A 7/1993 Maas et al.
5,238,152 A 8/1993 Maas et al.
5,332,128 A * 7/1994 Mass ..... B05B 11/0027 222/383.1
5,535,952 A 7/1996 Tada
5,730,335 A 3/1998 Maas et al.
5,884,820 A * 3/1999 Thanisch ..... B05B 11/007 222/335
6,006,950 A 12/1999 Watanabe et al.
6,036,057 A * 3/2000 Poutiatine ..... B05B 11/0056 222/137
6,126,090 A 10/2000 Wadsworth et al.
6,186,366 B1 2/2001 Good et al.
6,364,172 B1 4/2002 Maas et al.
6,669,058 B1 12/2003 Sweeton
6,715,698 B2 4/2004 Foster et al.
2002/0011501 A1* 1/2002 Main ..... A61D 7/00 222/630
2004/0149837 A1 8/2004 Foster
2004/0251316 A1 12/2004 Stark
2007/0056991 A1 3/2007 Good
2007/0102458 A1* 5/2007 Valley ..... B05B 9/01 222/334
2007/0295758 A1 12/2007 Foster et al.
2008/0011882 A1 1/2008 Foster et al.
2009/0050653 A1 2/2009 Maas et al.
2009/0256008 A1 10/2009 Foster et al.
2012/0199605 A1 8/2012 Alluigi
2015/0190828 A1* 7/2015 Alluigi ..... B05B 11/3011 239/526

FOREIGN PATENT DOCUMENTS

EP 0798050 A1 10/1997
EP 1103308 A2 5/2001
EP 1974826 A1 10/2008
JP 08252508 A 10/1996
JP 11104022 A 4/1999
WO 9638374 A1 12/1996
WO 9726086 A2 7/1997
WO 0033970 A1 6/2000
WO 2011051825 A1 5/2011

OTHER PUBLICATIONS

Intellectual Property Office of Great Britain, Search Report Issued in Patent Application No. GB1110250.6, dated Sep. 8, 2011, South Wales, 5 pages.
ISA European Patent Office, International Search Report and Written Opinion Issued in Application No. PCT/GB2012/000426, dated Oct. 9, 2012, WIPO, 23 pages.
European Patent Office, Extended European Search Report Issued in Application No. 16177026.8, dated Oct. 16, 2016, Germany, 11 pages.

* cited by examiner

TRIGGER PUMP DISPENSER WITH INTERCHANGEABLE PISTON

CROSS-REFERENCE TO RELATED APPLICATIONS

The present application is a divisional of U.S. application Ser. No. 13/824,949, entitled "Trigger Pump Dispenser With On/Off Indicator" filed on Jun. 18, 2013, which is the U.S. National Phase of International PCT Application Serial No. PCT/GB2012/000426, entitled "A Trigger Pump Dispenser," filed May 14, 2012, which claims priority to Great Britain Application No. 1110250.6, filed Jun. 16, 2011, each of which are hereby incorporated by reference in their entirety for all purposes.

TECHNICAL FIELD

The present invention relates generally to dispensers for liquid products and particularly to so-called "trigger pumps" of the kind which have a trigger operable to drive a piston along a pump chamber against the action of a spring and so to force liquid product under pressure from the pump chamber and through a dispensing orifice in a nozzle.

BACKGROUND AND SUMMARY

According to a first aspect of the present invention there is provided a trigger pump dispenser comprising: a body; an outlet nozzle; a pump chamber; a piston for defining a variable volume in the pump chamber and movable between a retracted position of larger chamber volume and an inserted position of lesser chamber volume; a trigger coupled with the piston and movable between a starting position at which the piston is in the retracted position and a depressed position at which the piston is in the inserted position; biasing means for biasing the trigger towards its retracted position; an inlet port and an outlet port defined by the body and adapted to be in communication with the pump chamber; an inlet valve adapted to close the inlet port when liquid to be dispensed is in the pump chamber and the piston is moved from the retracted position to the inserted position as the pump chamber decreases in volume, the inlet valve being adapted to open the inlet port when liquid to be dispensed is drawn into the pump chamber through the inlet port as the pump chamber volume increases when the piston is moved from the inserted position to the retracted position, and an outlet valve adapted to open the outlet port when the pump chamber decreases in volume as liquid therein is dispensed through the outlet port and adapted to close when the pump chamber increases in volume, the outlet valve comprising a precompression valve operable to allow liquid through the outlet only after a predetermined elevated pressure is established in the pump chamber, the valve having a movable valve member carried on or by a spring member which biases the valve member to a closed position but flexes in response to the elevated pressure in the chamber acting on the valve member to move the valve member to an open position so that liquid can pass from the chamber and thereafter be dispensed through the outlet nozzle.

This aspect of the invention therefore provides a precompression function in a pumping cylinder of a trigger sprayer which only allows pressurised liquid to be expelled when the pressure of the liquid in the cylinder is above a certain predetermined level. The precompression system can be used to prevent fluid from being discharged at too low a pressure and allows for an improved spraying pattern as liquid can be pressed out of an outlet nozzle at a predetermined and relatively high pressure.

The spring valve member may comprise a flexible annulus which can carry the movable valve member and flex once the predetermined elevated pressure is reached to allow the movable valve member to move to its open position and thereafter return the member to the closed position when the elevated pressure state in the chamber is removed at the end of the pressure stroke.

The valve body member may be inflexible. In other words, it is the spring valve member which flexes in order to move the valve member rather than that valve member itself flexing.

According to an alternative aspect of the present invention there is provided a trigger pump dispenser comprising: a body; an outlet nozzle; a pump chamber; a piston for defining a variable volume in the chamber and thereby pumping liquid into and out of the chamber for dispensing through the outlet nozzle; a trigger coupled with the piston and movable to cause the piston to pump liquid; and biasing means for biasing the trigger to a retracted position, where the nozzle is movable between a first position in which it is in fluid communication with the pump chamber and a second position in which fluid communication is blocked, the pump comprising child-resistant locking means for locking the nozzle in the second position and which must be released to allow movement to the first position.

This aspect of the present invention therefore provides a safety feature which can lock the trigger pump in a closed position in which liquid cannot be dispensed through the outlet nozzle. A child-resistant feature is provided on the pump, for example on the nozzle itself, which must be disengaged before the nozzle can be moved to a position in which liquid can be dispensed there through.

In one embodiment the locking means comprises a resilient member provided on the nozzle and movable between a locked position and an unlocked position. The combination of a requirement for the locking means to be disengaged as well as the nozzle to be moved to the second position can be used to provide an effective child-resistant feature.

According to a further aspect there is provided a trigger pump dispenser comprising: a body; an outlet nozzle; a pump chamber; a dispensing passage; a piston for defining a variable volume in the chamber and thereby pumping liquid into and out of the chamber for dispensing through the nozzle via the dispensing passage; a trigger coupled with the piston and movable to cause the piston to pump liquid; biasing means for biasing the trigger to a retracted position; and a shroud, where the nozzle is movable between a first 'on' position in which it is in fluid communication with the dispensing passage and a second 'off' position in which fluid communication is blocked, the nozzle having indicator means carried on or by the nozzle body which are alternatively brought into register with windows on the shroud to indicate if the nozzle is in the 'on' or 'off' position.

Aspects of the present invention and embodiments thereof may be provided in combination with a container.

Aspects and embodiments of the present invention may be used separately or in combination.

The present invention will now be more particularly described, by way of example, with reference to the accompanying drawings, in which:

BREIF DESCRIPTION OF FIGURES

DETAILED DESCRIPTION

Figure 1:
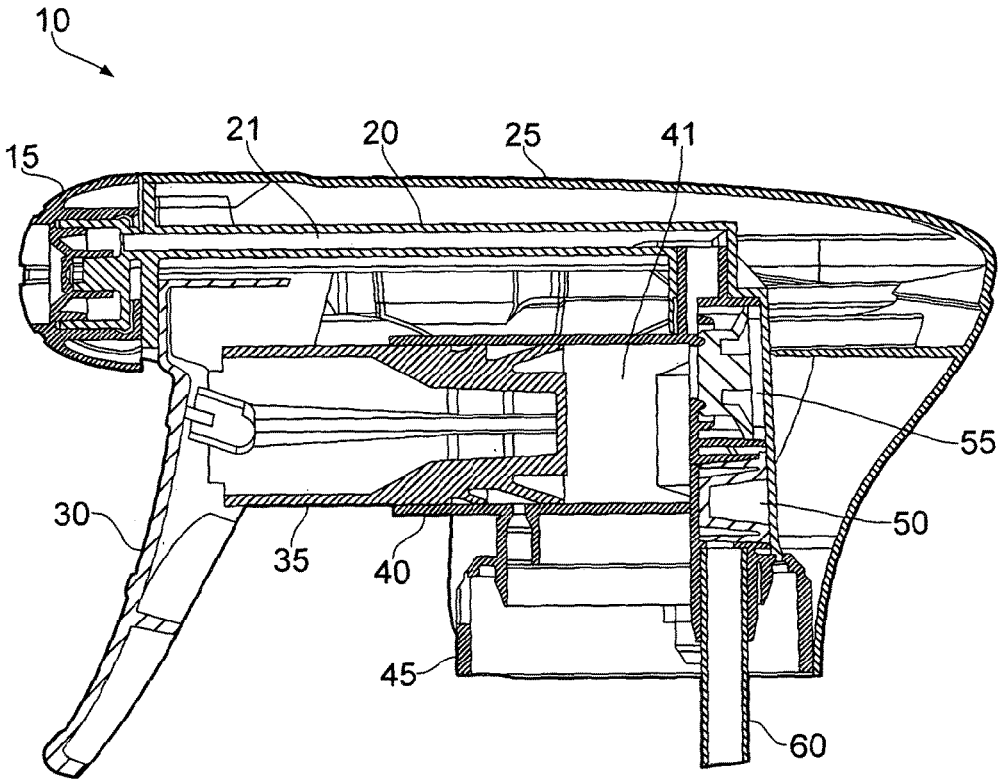
FIG. 1 is a section of a trigger pump dispenser formed according to an embodiment of the present invention.

Referring first to FIG. 1 there is shown a trigger pump dispenser generally indicated at 10.

The dispenser comprises: a nozzle 15; a dispensing barrel 20; a shroud 25; a trigger 30; a piston 35; a pump cylinder 40; a closure 45; an inlet valve 50; an outlet valve 55; and a dip tube 60.

The trigger 30 can be used to cause the piston 35 to move within the cylinder 40. The interior of the cylinder 40 defines a pump chamber 41, the effective volume of which is defined by the piston 35. Movement of the piston 35 to increase the pump chamber volume causes fluid from an associated container 165 to be drawn up through the dip tube 60 and into the cylinder 40 via the inlet valve 50. During this "sucking" stroke the outlet valve 55 remains shut. When the trigger 30 is pulled towards the closure 45 the piston 35 is moved to decrease the pump chamber volume. This causes the inlet valve 50 to shut and the outlet valve 55 to open as described in more detail below with reference to FIGS. 5 and 6. Liquid from the pump chamber flows through a dispensing passage 21 in the barrel to the nozzle 15 for dispensing.

In order to return the trigger to the rest position a biasing means (e.g., spring) 170 is provided which biases it to the rest position.

In order to return the trigger to the rest position a spring (not shown for clarity) is provided which biases it to the rest position.

Figure 6:
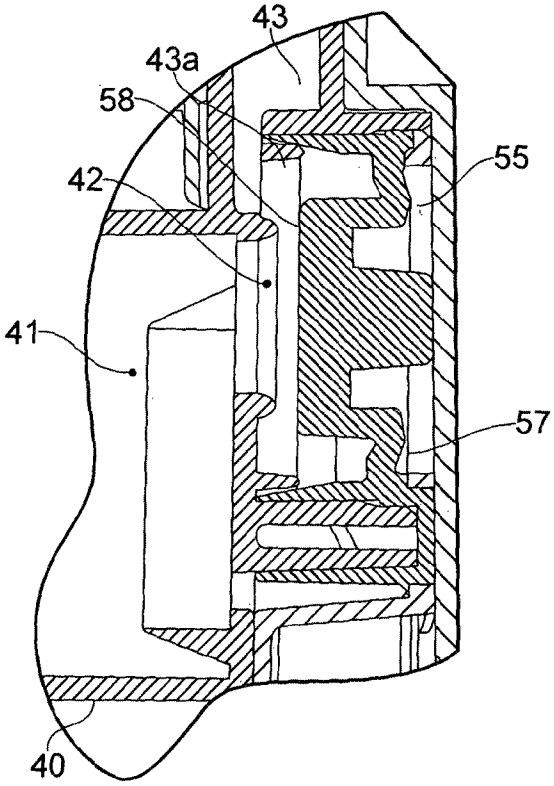
FIG. 6 is a section of the valve of FIG. 5 shown in an open position.
Figure 5:
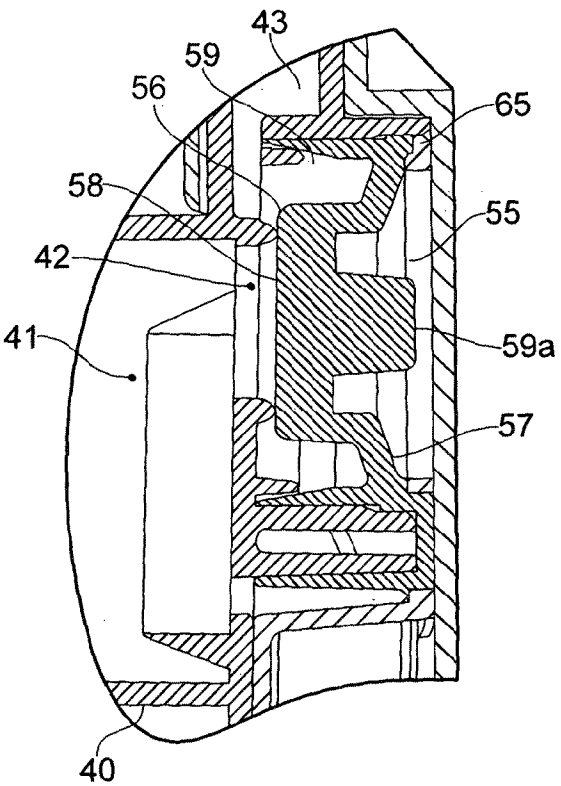
FIG. 5 is a section of an outlet valve forming part of the dispenser of FIG. 1 and shown in a closed position.

Referring now to FIGS. 5 and 6 the outlet valve 55 is shown in more detail.

In FIG. 5 the valve 55 is shown in the closed position. In this position an outlet port 42 from the pump chamber 41 is blocked and liquid in the chamber 41 cannot pass into an outlet passage 43 that leads to the dispensing barrel.

The valve 55 comprises a movable valve member 56 which is supported on an annular spring member 57. The member 56 comprises a disc-shape pressure plate 58 from the periphery of which the spring 57 extends. At the other end of the spring 57 an annular retention leg 59 projects and is used to hold the valve 55 against the pump chamber cylinder 40. A stop block 59A projects from the rear face of the pressure disc 58.

In this embodiment the valve 55 is formed from a thermoplastic elastomer material and is carried on a base 65 formed from polypropylene, which gives a degree of rigidity to the structure.

In use, as the piston causes a decrease in the pump chamber volume pressure builds up against the disc 58. The disc 58 is held in position by the spring 57 until a predetermined pressure threshold is reached after which the disc 58 is pushed away from the outlet port 42 as shown in FIG. 6. The disc 58 itself is inflexible and moves by virtue of the flexing of the spring 57. This causes the valve 55 to move away from the outlet 43A at the entrance to the passage 43 so that liquid can be forced from the chamber 41 into the passage 43 and onward for dispensing.

Figure 2:
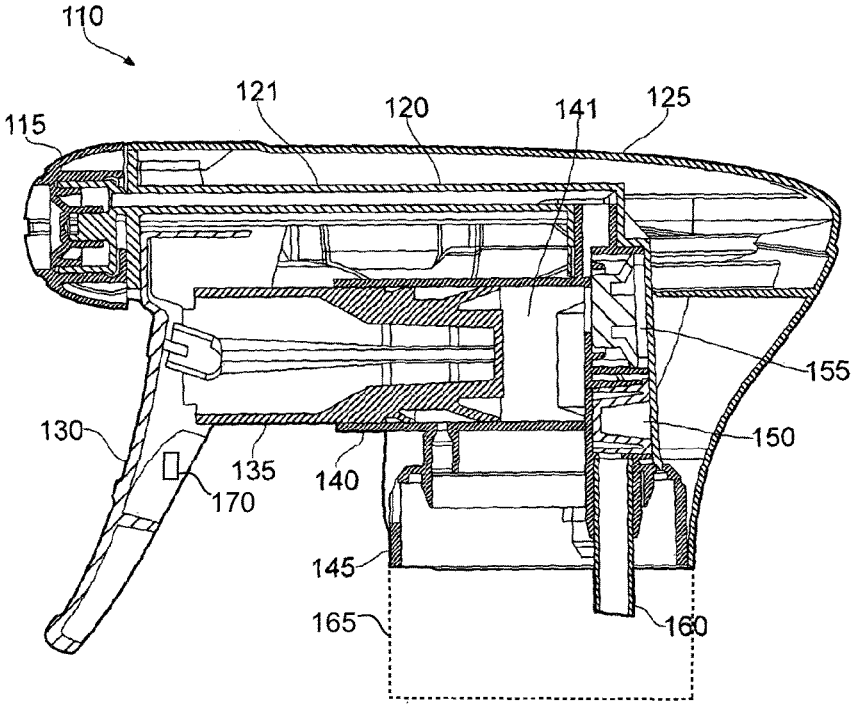
FIG. 2 is a section of a trigger pump dispenser formed according to an alternative embodiment of the present invention.
Figure 3:
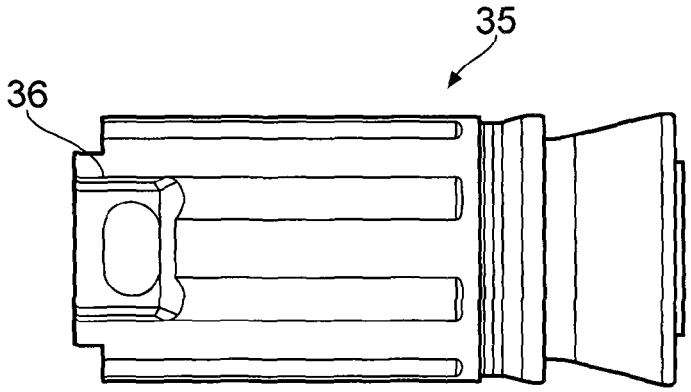
FIG. 3 is a side elevation of a piston forming part of the dispenser of FIG. 1.
Figure 4:
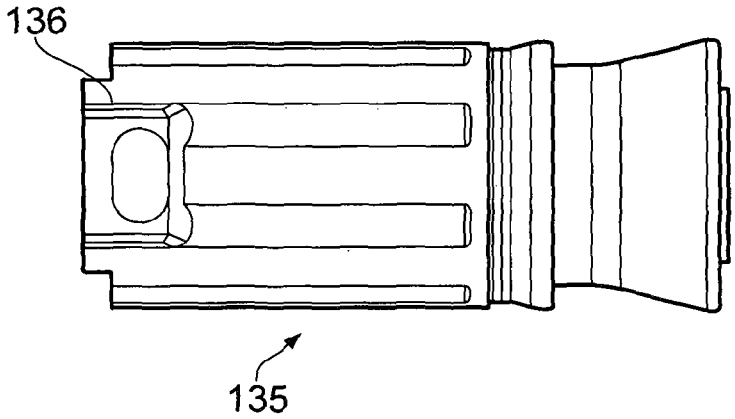
FIG. 4 is a side elevation of a piston forming part of the dispenser of FIG. 2.

Referring now to FIG. 2 there is shown a trigger pump 110 formed according to an alternative embodiment. The pump 110 is identical to the pump 10 shown in FIG. 1 except that the piston 135 is longer as also illustrated in FIGS. 3 and 4 showing the pistons 35, 135 from FIGS. 1 and 2 respectively.

Both pistons 35, 135 are provided with identical connection means 36, 136 for connecting them to the trigger 30, 130. By providing standardised interconnection means different sized pistons can easily be substituted into the remainder of the dispenser. By providing a longer piston for the dispenser 110 the maximum fill volume of the pump chamber 141 is effectively decreased, as is the stroke length. This means that a dispenser with a lower capacity is easily formed.

Referring now to FIGS. 7 to 10 there is shown a child-resistant nozzle arrangement formed according to an alternative aspect of the present invention.

The nozzle 215 is rotatably connected to the end of a dispensing barrel 220. The dispensing barrel 220 includes an arcuate dispensing outlet 222 through which liquid to be dispensed must flow.

The nozzle 215 can be rotated relative to the barrel 220 between an open and a closed position which are 180° apart. In an open position the nozzle inlet is aligned with the discharge outlet 222 of the barrel 220; whereas in the closed position the inlet and outlet are not aligned. The nozzle can thereby be moved into and out of fluid communication with a pump chamber.

The nozzle 215 is provided with a tamper evident locking pin 216 shaped to fit into a notch 223 formed in a locking plate 224 on the barrel 220. When the pin 216 is engaged in the notch 223 the nozzle 215 cannot be rotated. The pin 216 is carried on a resilient arm 217 which supports a push tab 218.

In order to disengage the pin 216 from the notch 223 the pull tab 216 is pushed away from the barrel plate 224. The nozzle 215 can now be rotated so that the outlet 222 is in alignment with its inlet and product can be dispensed. In the open position the pin 216 rests in a further notch 223A which is opposite the notch 223 on the plate 224. Each side of the notch 223A is defined by an inclined edge 223B. Because the edges 223B are inclined, the nozzle can be moved from the open position to the closed position without the need to move the tab 218 because the pin 216 can ride up the edges 223B so as automatically to disengage it from the slot 223A.

Figure 7:
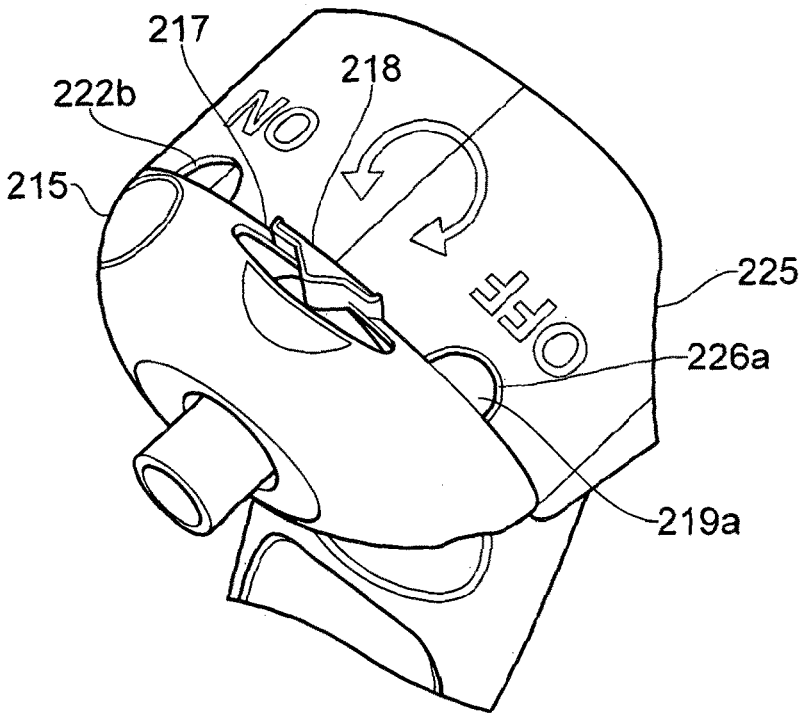
FIG. 7 is a perspective view of a child-resistant spray nozzle formed according to an alternative embodiment of the present invention.
Figure 8:
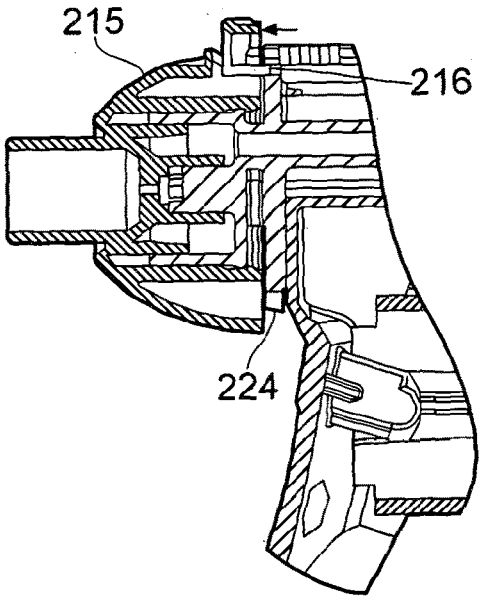
FIG. 8 is a section of the nozzle arrangement of FIG. 7.
Figure 9:
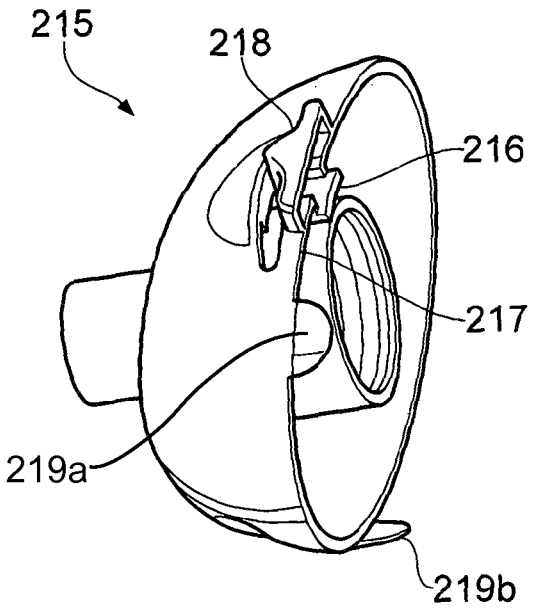
FIG. 9 is a rear perspective view of the nozzle of FIGS. 7 and 8.
Figure 10:
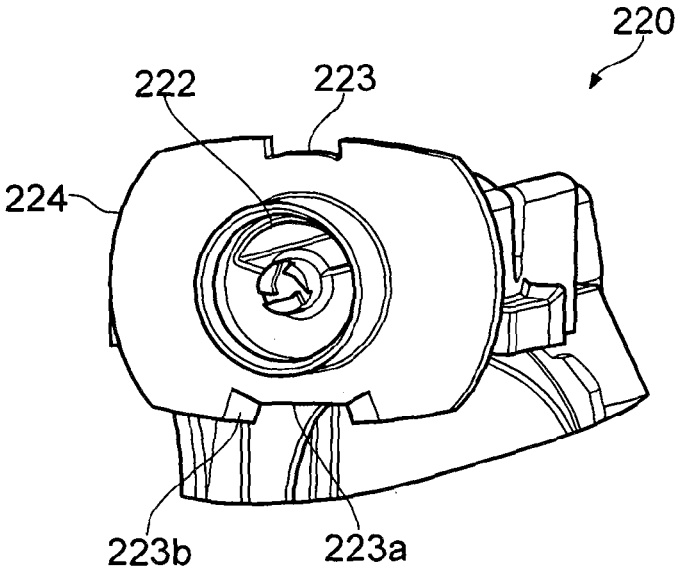
FIG. 10 is a perspective view of a dispensing barrel forming part of the dispenser shown in FIG. 8.

The nozzle 215 is provided with two identical semi-circular tabs 219A, 219B. The tab 219A is positioned so that when the nozzle 215 is in the off position as shown in FIG. 7 the tab 219A resides in a semi-circular cut-out 226A provided on the cowl 225. Similarly, the tab 219B is positioned so that when the nozzle 215 is rotated to the on position it resides in a cut-out 222B in the cowl 225. A clear indication of whether the nozzle is in the on or off position is thereby provided, as well as an effective child-resistant functionality.

Figure 11:
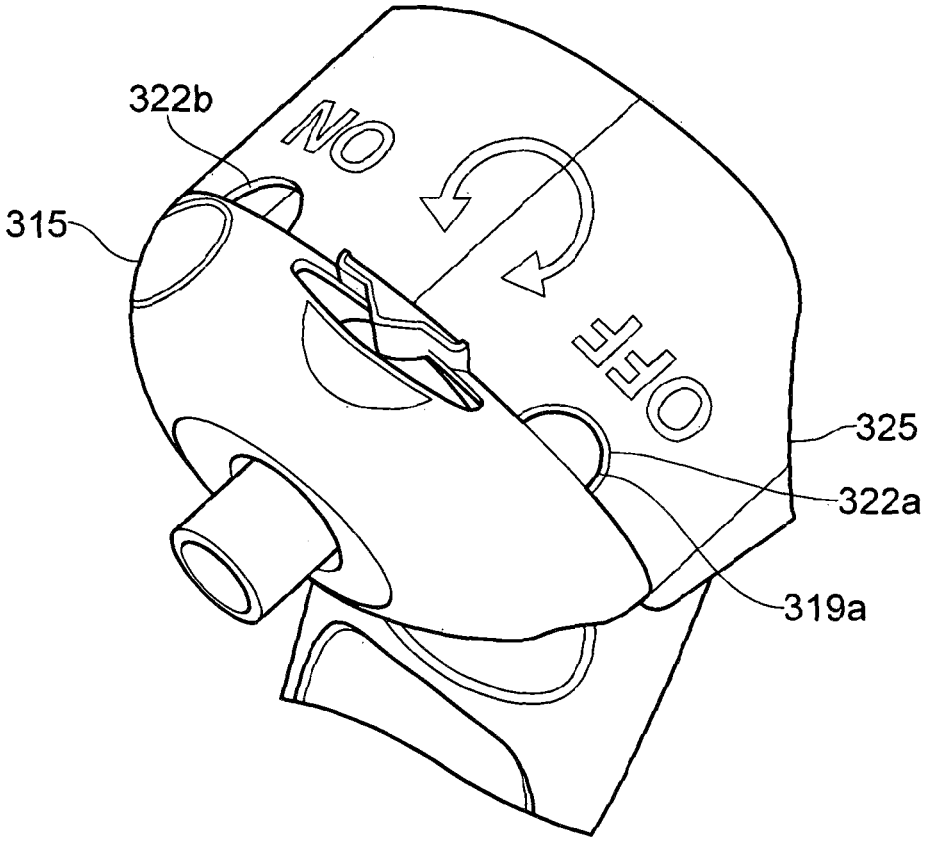
FIG. 11 is a perspective view of a nozzle arrangement formed according to an alternative embodiment.

Referring now to FIG. 11 there is shown a nozzle 315 formed according to an alternative embodiment. The nozzle 315 is similar to the nozzle 215 of FIGS. 7 to 9, except that in this embodiment there is no child-resistant feature; so the nozzle is freely movable between the on and off positions. The nozzle 315 is again provided with indicator tabs which alternately become visible in different respective windows 322*a*, 322*b* in the upper surface of the shroud 325 depending on the open/closed status of the nozzle.

It will be appreciated that the different aspects and embodiments described herein can be used together or separately.

The invention claimed is:

1. A trigger pump dispenser comprising:

a body;

an outlet nozzle;

a pump chamber;

a piston for defining a variable volume in the pump chamber and thereby pumping liquid into and out of the pump chamber for dispensing through the outlet nozzle, the piston having a first length;

a trigger coupled with the piston, via an interconnection, the trigger movable from a rest position to a depressed position to cause the piston to move from a retracted position to an inserted position to pump liquid; and biasing means for biasing the trigger to the rest position;

wherein the piston is moved back towards the retracted position as the trigger moves back towards the rest position under the action of the biasing means; and wherein the piston is interchangeably associatable with the trigger and the pump chamber so that at least a second piston having a second length, the second length different from the first length, is couplable to the trigger by a second interconnection that is standardized with the interconnection, wherein substitutable pistons having different lengths are usable to determine different maximum fill volumes of the pump chamber.

2. The trigger pump dispenser of claim 1, wherein the biasing means for biasing the trigger to the rest position comprises a spring.

3. The trigger pump dispenser of claim 1, wherein the trigger pump dispenser is arranged on a container.

4. The trigger pump dispenser of claim 1, wherein the piston is movable between a retracted position of larger chamber volume and an inserted position of lesser chamber volume, and wherein the trigger is movable from a rest position at which the piston is in the retracted position and a depressed position at which the piston is in the inserted position;

the trigger pump dispenser comprising:

an inlet port and an outlet port defined by the body and adapted to be in communication with the pump chamber; and an inlet valve adapted to close the inlet port when liquid to be dispensed is in the pump chamber and the piston is moved from the retracted position to the inserted position as the pump chamber decreases in volume, the inlet valve being adapted to open the inlet port when liquid to be dispensed is drawn into the pump chamber through the inlet port as the pump chamber volume increases when the piston is moved from the inserted position to the retracted position, and an outlet valve adapted to open the outlet port when the pump chamber decreases in volume as liquid therein is dispensed through the outlet port and adapted to close when the pump chamber increases in volume;

wherein the outlet valve comprises a precompression valve operable to allow liquid through the outlet nozzle only after a predetermined elevated pressure is established in the pump chamber, the precompression valve comprising an inflexible pressure plate coupled at its periphery by an annular spring member which biases the inflexible pressure plate to a closed position but flexes in response to the predetermined elevated pressure in the pump chamber acting on the inflexible pressure plate to move the inflexible pressure plate to an open position so that liquid can pass from the pump chamber and thereafter be dispensed through the outlet nozzle.

5. The trigger pump dispenser of claim 4, further comprising a stop block projecting from the inflexible pressure plate to limit movement of the inflexible pressure plate.

6. The trigger pump dispenser of claim 5, in which the annular spring member comprises an annular retention leg for holding the outlet valve against a wall of the pump chamber.

7. The trigger pump dispenser of claim 1, wherein the trigger pump dispenser comprises a dispensing passage and the outlet nozzle is movable between a first "on" position in which it is in fluid communication with the dispensing passage and a second "off" position in which fluid communication with the dispensing passage is blocked.

8. The trigger pump dispenser of claim 7, wherein the outlet nozzle is rotatable between the first "on" position and the second "off" position.

9. The trigger pump dispenser of claim 8, wherein the first "on" position and the second "off" position are 180° apart.

10. The trigger pump dispenser of claim 7, wherein the outlet nozzle is freely movable between the first "on" position and the second "off" position.

11. The trigger pump dispenser of claim 7, further comprising child-resistant locking means for locking the outlet nozzle in the second "off" position and which must be released to allow movement to the first "on" position.

12. The trigger pump dispenser of claim 11, wherein the child-resistant locking means comprises a locking pin projecting from the outlet nozzle that is shaped to engage with a notch in the body when the outlet nozzle is in the second "off" position and the locking pin is releasable by user engagement of the locking pin on the outlet nozzle to move the locking pin out of engagement with the notch in the body.

13. The trigger pump dispenser of claim 12, wherein the locking pin is carried on a resilient arm on the outlet nozzle.

14. The trigger pump dispenser of claim 13, wherein the resilient arm supports a push tab.

15. The trigger pump dispenser of claim 14, wherein the locking pin is releasable by user engagement of the push tab.

16. The trigger pump dispenser of claim 15, wherein in the first "on" position, the locking pin resides in a second notch in the body, the second notch being shaped such that the outlet nozzle can be rotated from the first "on" position to the second "off" position without releasing the locking pin.

17. The trigger pump dispenser of claim 15, in which the outlet nozzle comprises a nozzle inlet and is connected to an end of a dispensing barrel that includes an arcuate dispensing outlet through which liquid to be dispensed can flow.

18. The trigger pump dispenser of claim 17, in which the outlet nozzle is rotatable relative to the dispensing barrel between an "open" position in which the nozzle inlet is aligned with the dispensing outlet of the dispensing barrel and a "closed"position in which the nozzle inlet is not aligned with the dispensing outlet of the dispensing barrel.

19. The trigger pump dispenser of claim 18, wherein the "open" position and the "closed" position are 180° apart.

* * * * *